US008387399B1

(12) United States Patent
York et al.

(10) Patent No.: US 8,387,399 B1
(45) Date of Patent: Mar. 5, 2013

(54) SYSTEM AND METHOD FOR CONTROLLING A COMBUSTOR ASSEMBLY

(75) Inventors: William David York, Greer, SC (US); Willy Steve Ziminsky, Simpsonville, SC (US); Thomas Edward Johnson, Greer, SC (US); Christian Xavier Stevenson, Inman, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/229,950

(22) Filed: Sep. 12, 2011

(51) Int. Cl.
*F02C 1/00* (2006.01)

(52) U.S. Cl. ..... 60/772; 60/779

(58) Field of Classification Search ..... 60/772, 60/725, 779, 773, 749, 776, 39.281, 39.091; 431/12–14, 17, 76, 79
See application file for complete search history.

(56) References Cited

U.S. PATENT DOCUMENTS

| | | | | |
|---|---|---|---|---|
| 4,528,918 | A | 7/1985 | Sato et al. | |
| 5,148,667 | A * | 9/1992 | Morey | 60/779 |
| 5,249,954 | A | 10/1993 | Allen et al. | |
| 5,547,369 | A | 8/1996 | Sohma et al. | |
| 5,978,525 | A * | 11/1999 | Shu et al. | 385/12 |
| 7,334,413 | B2 * | 2/2008 | Myhre | 60/803 |
| 7,336,897 | B2 | 2/2008 | Williamson | |
| 7,486,864 | B2 | 2/2009 | Diatzikis | |
| 2005/0180699 | A1 * | 8/2005 | Shu et al. | 385/89 |
| 2008/0083228 | A1 * | 4/2008 | Myhre | 60/773 |
| 2010/0175384 | A1 | 7/2010 | Kraemer et al. | |

* cited by examiner

*Primary Examiner* — Phutthiwat Wongwian
(74) *Attorney, Agent, or Firm* — Dority & Manning, P.A.

(57) ABSTRACT

A system and method for controlling a combustor assembly are disclosed. The system includes a combustor assembly. The combustor assembly includes a combustor and a fuel nozzle assembly. The combustor includes a casing. The fuel nozzle assembly is positioned at least partially within the casing and includes a fuel nozzle. The fuel nozzle assembly further defines a head end. The system further includes a viewing device configured for capturing an image of at least a portion of the head end, and a processor communicatively coupled to the viewing device, the processor configured to compare the image to a standard image for the head end.

20 Claims, 5 Drawing Sheets

FIG. —4—

SYSTEM AND METHOD FOR CONTROLLING A COMBUSTOR ASSEMBLY

This invention was made with government support under contract number DE-FC26-05NT42643 awarded by the Department of Energy. The government has certain rights in the invention.

FIELD OF THE INVENTION

The subject matter disclosed herein relates generally to combustor assemblies, and more particularly to systems and methods for controlling combustor assemblies.

BACKGROUND OF THE INVENTION

Turbine systems are widely utilized in fields such as power generation. For example, a conventional gas turbine system includes a compressor assembly, a combustor assembly, and a turbine assembly. Compressed air is provided from the compressor assembly to the combustor assembly. The air entering the combustor assembly is mixed with fuel, and this mixture is combusted. Hot gases of combustion flow from the combustor assembly to the turbine assembly to drive the gas turbine system and generate power.

Recently, flexible fuel combustion systems for gas turbine systems have been developed. Such flexible fuel systems are adaptable to combust a wide range of fuels with various fuel compositions and heating values. These systems have led to improvements in power generation and power plant efficiency and, in some cases, reductions in $NO_x$ emissions.

However, the development of flexible fuel gas turbine systems has led to increases in combustion instabilities during operation. For example, the use of highly reactive fuel blends has led to increases in combustion instabilities, such as flashback and/or flame holding, which can damage or destroy various components in the combustor assembly and gas turbine system.

Various cooling systems have been developed to moderate the temperature of a fuel nozzle assembly in case of a combustion instability, which may allow the fuel nozzle assembly to survive for a somewhat extended period of time. However, these cooling systems are only temporarily solutions, and typically do not correct or eliminate such combustion instabilities when they occur. Other various systems utilize thermocouples to detect such combustion instabilities, or use cameras or other technology to view and monitor the flame created within a combustor. However, such systems have been found to be relatively inaccurate and ineffective at detecting combustion instabilities.

Accordingly, improved systems and methods for controlling combustor assemblies would be desired in the art. For example, a system and method that allow for detection and correction of combustion instabilities would be advantageous.

BRIEF DESCRIPTION OF THE INVENTION

Aspects and advantages of the invention will be set forth in part in the following description, or may be obvious from the description, or may be learned through practice of the invention.

In one embodiment, a system for controlling a combustor assembly is disclosed. The system includes a combustor assembly. The combustor assembly includes a combustor and a fuel nozzle assembly. The combustor includes a casing. The fuel nozzle assembly is positioned at least partially within the casing and includes a fuel nozzle. The fuel nozzle assembly further defines a head end. The system further includes a viewing device configured for capturing an image of at least a portion of the head end, and a processor communicatively coupled to the viewing device, the processor configured to compare the image to a standard image for the head end.

In another embodiment, a method for controlling a combustor assembly is disclosed. The method includes capturing an image of at least a portion of a head end of a fuel nozzle assembly for a combustor. The combustor includes a casing. The fuel nozzle assembly is positioned at least partially within the casing and includes a fuel nozzle. The fuel nozzle assembly further defines the head end. The method further includes comparing the image to a standard image for the head end.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
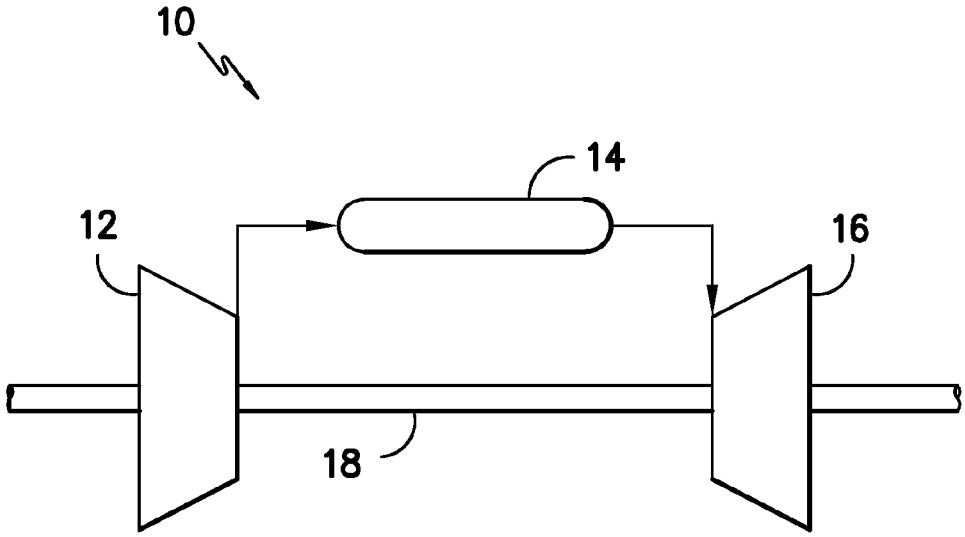
FIG. 1 is a schematic illustration of a gas turbine system.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a turbine system 10, which in exemplary embodiments is a gas turbine system 10. The system 10 may include a compressor assembly 12, a combustor assembly 14, and a turbine assembly 16. The combustor assembly 14 typically includes a plurality of combustors 15 disposed in a generally annular array. The compressor assembly 12 and turbine assembly 16 may be coupled by a shaft 18. The shaft 18 may be a single shaft or a plurality of shaft segments coupled together to form shaft 18. Shaft 18 may be directly or indirectly connected to a load, such as a generator of electric power.

Figure 2:
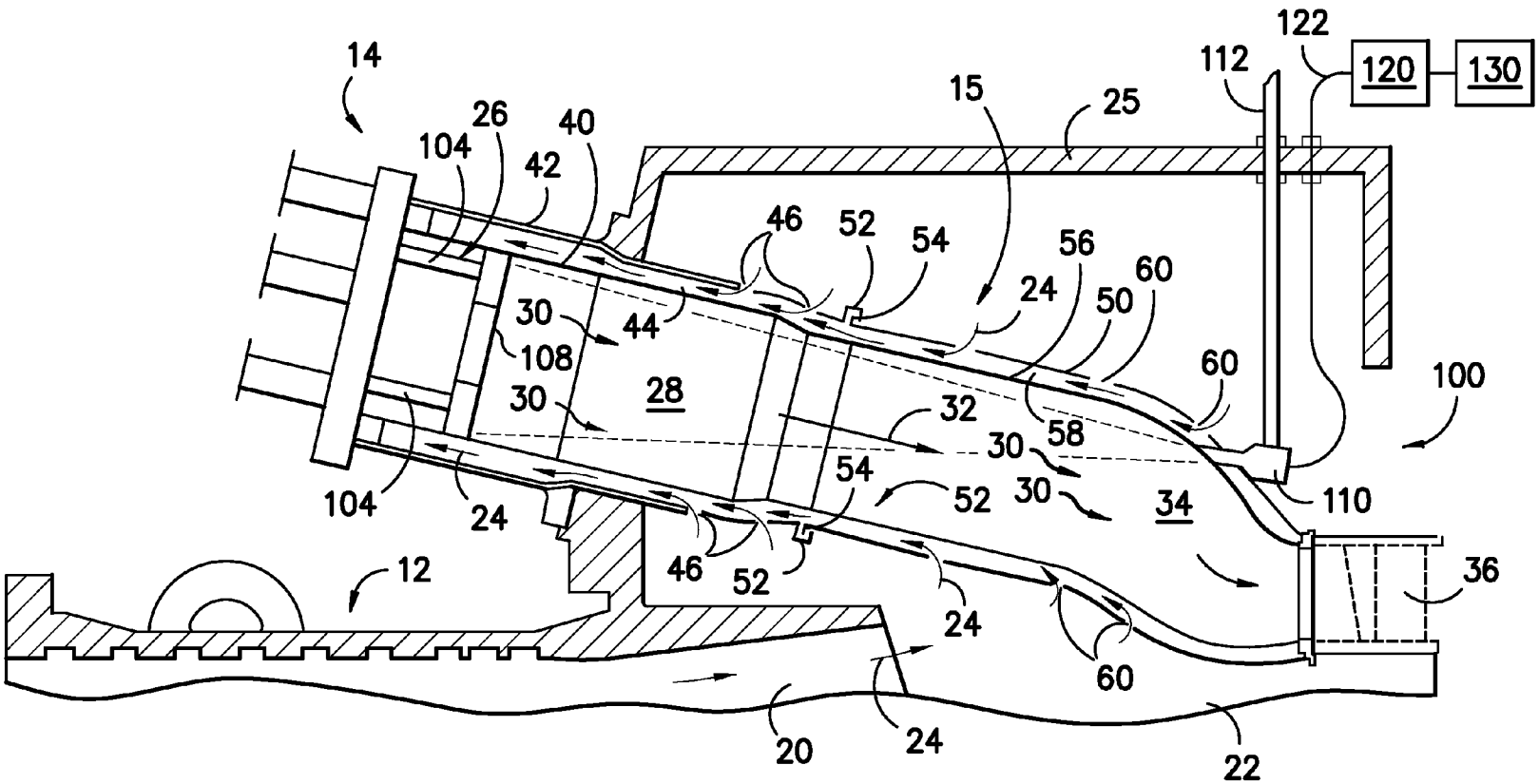
FIG. 2 is a side cutaway view of various components of a gas turbine system according to one embodiment of the present disclosure.
Figure 3:
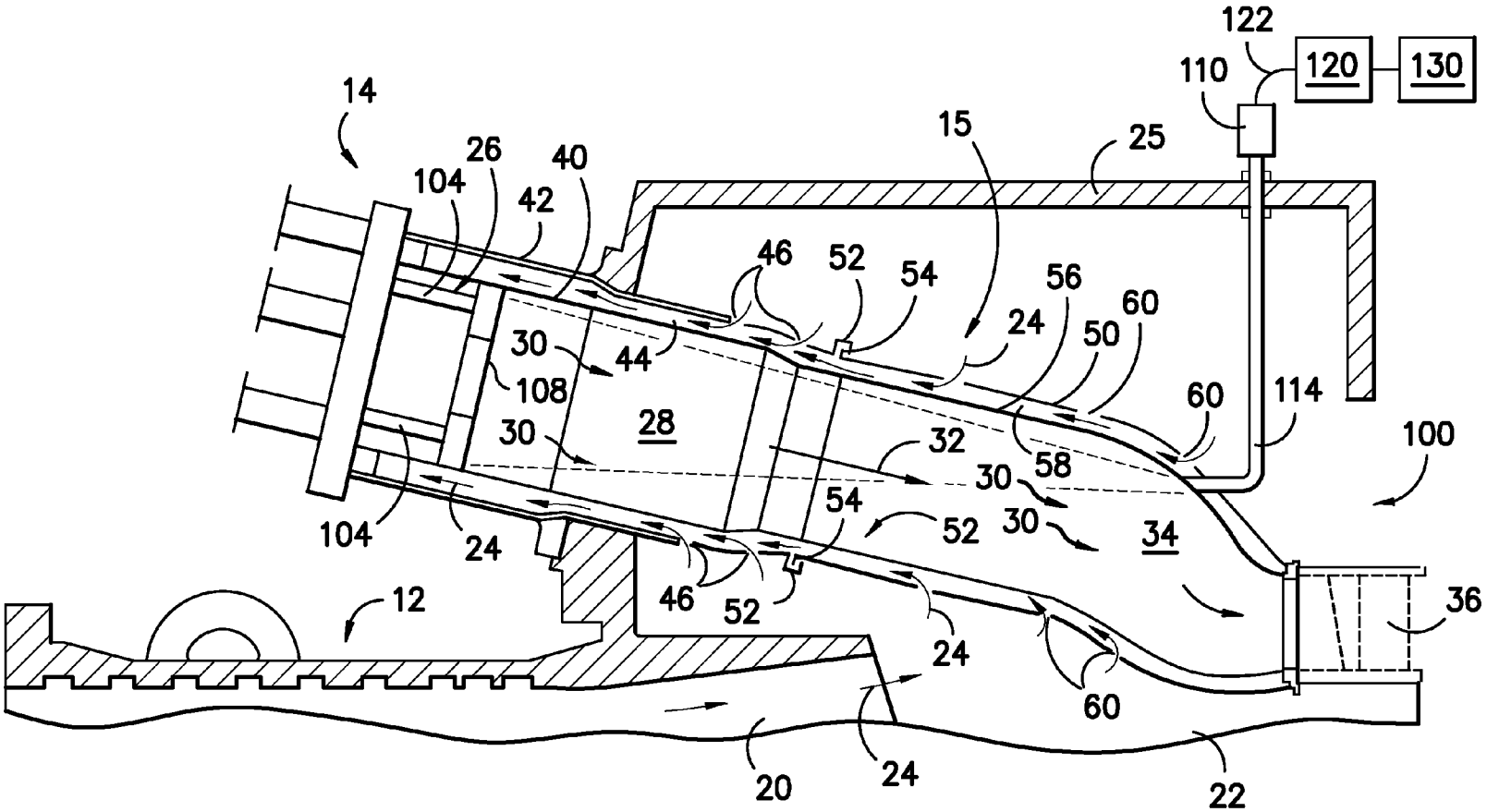
FIG. 3 is a side cutaway view of various components of a gas turbine system according to another embodiment of the present disclosure.

As illustrated in FIGS. 2 and 3, the combustor assembly 14 is generally fluidly coupled to the compressor assembly 12 and the turbine assembly 16. The compressor assembly 12 may include a diffuser 20 and a discharge plenum 22 that are coupled to each other in fluid communication, so as to facilitate the channeling of a working fluid 24 to the combustor assembly 14. As shown, at least a portion of the discharge plenum 22 is defined by an outer casing 25, such as a compressor discharge casing. After being compressed in the compressor assembly 12, working fluid 24 may flow through the diffuser 20 and be provided to the discharge plenum 22. The working fluid 24 may then flow from the discharge plenum 22 to the combustor assembly 14, such as to the combustors 15 thereof, wherein the working fluid 24 is combined with fuel from fuel nozzle assemblies 26, one or more of which are included with each combustor 15 in combustor assembly 14.

Suitable fuels according to the present disclosure include any suitable gas or liquid fuels, such as natural gas or an oil. Further, suitable fuels include fuels and fuel compositions that may be utilized in flexible fuel gas turbine systems, such as fuel compositions including hydrogen, carbon monoxide, methane, other hydrocarbons, and/or inerts, such as nitrogen.

After mixing with the fuel, the working fluid 24/fuel mixture may be ignited within a combustion chamber 28 in a combustor 15 to create hot gas flow 30 through that combustor 15. The hot gas flow 30 may be channeled through the combustion chamber 28 along a hot gas path 32 into a transition piece cavity 34 and through a turbine nozzle 36 to the turbine assembly 16.

A combustor 15 may comprise a hollow annular wall configured to facilitate working fluid 24. For example, the combustor 15 may include a combustor liner 40 disposed within a flow sleeve 42. The arrangement of the combustor liner 40 and the flow sleeve 42, as shown in FIG. 2, is generally concentric and may define an annular passage or flow path 44 therebetween. In certain embodiments, the flow sleeve 42 and the combustor liner 40 may define a first or upstream hollow annular wall of the combustor 15. The flow sleeve 42 may include a plurality of inlets 46, which provide a flow path for at least a portion of the working fluid 24 from the compressor 12 through the discharge plenum 22 into the flow path 44. In other words, the flow sleeve 42 may be perforated with a pattern of openings to define a perforated annular wall. The interior of the combustor liner 40 may define the substantially cylindrical or annular combustion chamber 28 and at least partially define the hot gas path 32 through which hot gas flow 30 may be directed.

Downstream from the combustor liner 40 and the flow sleeve 42, an impingement sleeve 50 may be coupled to the flow sleeve 42. The flow sleeve 42 may include a mounting flange 52 configured to receive a mounting member 54 of the impingement sleeve 50. A transition piece 56 may be disposed within the impingement sleeve 50, such that the impingement sleeve 50 surrounds at least a portion of the transition piece 56. A concentric arrangement of the impingement sleeve 50 and the transition piece 56 may define an annular passage or flow path 58 therebetween. The impingement sleeve 50 may include a plurality of inlets 60, which may provide a flow path for at least a portion of the working fluid 24 from the compressor assembly 12 through the discharge plenum 22 into the flow path 58. In other words, the impingement sleeve 50 may be perforated with a pattern of openings to define a perforated annular wall. Interior cavity 34 of the transition piece 56 may further define hot gas path 32 through which hot gas flow 30 from the combustion chamber 28 may be directed into the turbine 16.

As shown, the flow path 58 is fluidly coupled to the flow path 44. Thus, together, the flow paths 44 and 58 define a flow path configured to provide working fluid 24 from the compressor assembly 12 and the discharge plenum 22 to the fuel nozzle assembly 26, while also cooling the combustor 15.

As discussed above, the turbine system 10, in operation, may intake working fluid 24 and provide the working fluid 24 to the compressor assembly 12. The compressor assembly 12, which is driven by the shaft 18, may rotate and compress the working fluid 24. The compressed working fluid 24 may then be discharged into the diffuser 20. The majority of the compressed working fluid 24 may then be discharged from the compressor assembly 12, by way of the diffuser 20, through the discharge plenum 22 and into the combustor assembly 14 or combustors 15 thereof. Additionally, a small portion (not shown) of the compressed working fluid 24 may be channeled downstream for cooling of other components of the turbine engine 10.

As shown, the outer casing 25 defining the discharge plenum 22 may at least partially surround the impingement sleeve 50 and the flow sleeve 42. A portion of the compressed working fluid 24 within the discharge plenum 22 may enter the flow path 58 by way of the inlets 60. The working fluid 24 in the flow path 58 may then be channeled upstream through flow path 44, such that the working fluid 24 is directed over the combustor liner 34. Thus, a flow path is defined in the upstream direction by flow path 58 (formed by impingement sleeve 50 and transition piece 56) and flow path 44 (formed by flow sleeve 42 and combustor liner 40). Accordingly, flow path 44 may receive working fluid 24 from both flow path 58 and inlets 46. The working fluid 24 flowing through the flow path 44 may then be channeled upstream towards the fuel nozzle assemblies 26, as discussed above.

The present disclosure may further be directed to a system 100 for controlling a combustor assembly 14. Such system 100 may be included in a turbine system 10, and may allow for control and elimination of combustion instabilities, such as flashback, flame holding, fuel or air path blockages, combustor blowout, or other suitable occurrences, during operation of the combustor assembly 14 and system 10.

Figure 4:
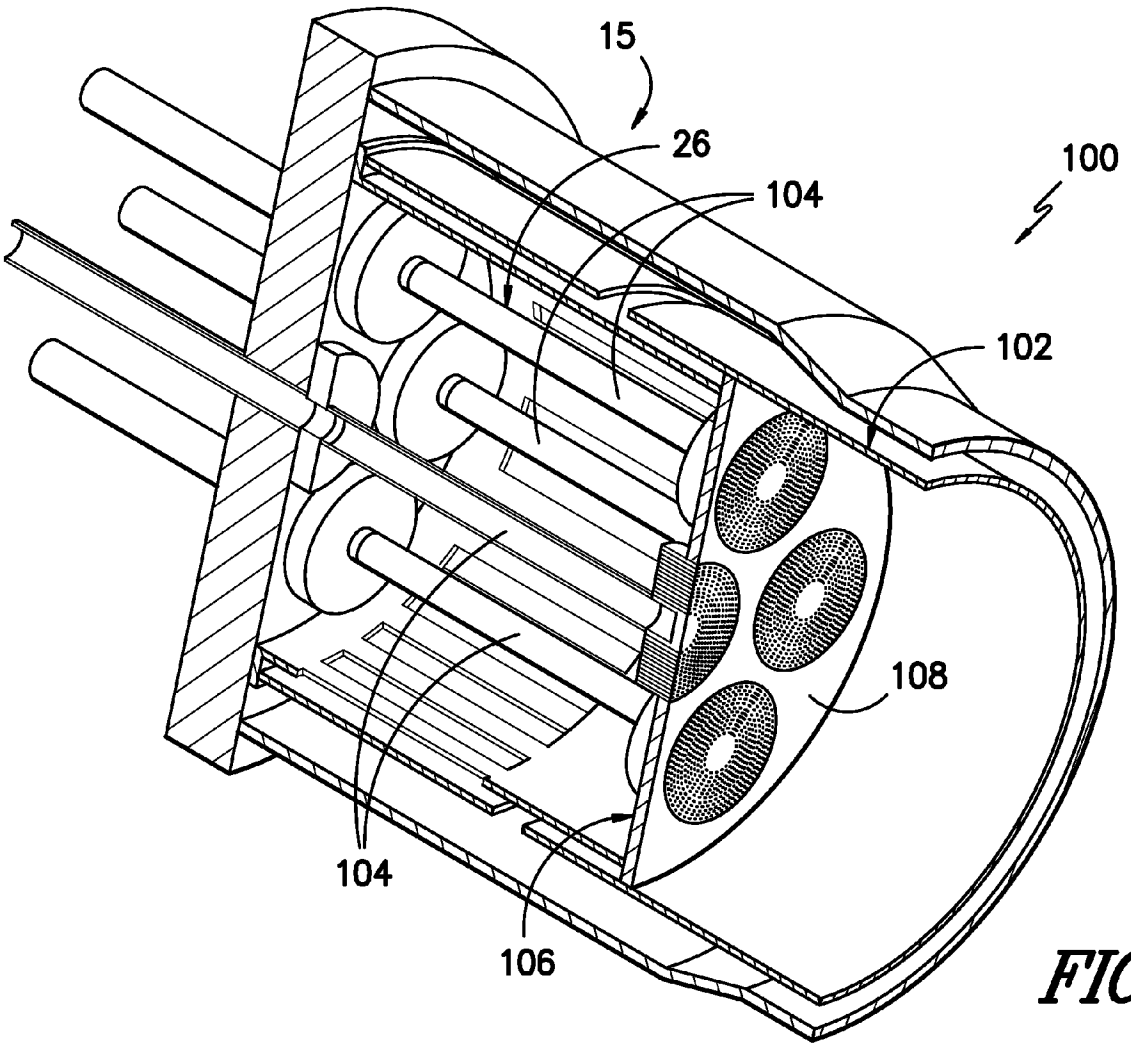
FIG. 4 is a perspective cutaway view of various components of a combustor assembly according to one embodiment of the present disclosure.

A system 100 according to the present disclosure may include a combustor assembly 14, which may include one or more combustors 15 and one or more fuel nozzle assemblies 26. As shown in FIG. 4, a combustor 15 may include casing 102, which may be formed from, for example, a combustor liner 40 and a separate or integrated transition piece 56. The fuel nozzle assembly 26 may be positioned at least partially within the casing 102, as shown. A fuel nozzle assembly 26 according to the present disclosure may include one or more fuel nozzles 104. For example, in one embodiment, a fuel nozzle assembly 26 may include seven fuel nozzles 104. Alternatively, however, a fuel nozzle assembly 26 according to the present disclosure may include one, two, three, four, five, six, eight, nine, ten, or more fuel nozzles 104, as desired or required. In some embodiments, a fuel nozzle assembly 26 may further include a cap assembly 106. The cap assembly 106 is provided for mounting the various fuel nozzles 104 thereto. Alternatively, the fuel nozzles 104 are mounted to each other, such that no cap assembly 106 is required. A fuel nozzle assembly 26 according to the present disclosure further defines a head end 108. The head end 108 is the end surface of the assembly 26 within the casing 102 that faces the combustion chamber 28, and from which fuel and working fluid 24 are exhausted for combustion.

A fuel nozzle assembly 26 according to the present disclosure may, in exemplary embodiments, include micro-mixer fuel nozzles and/or other suitable micro-mixer technology as shown. Alternatively, however, the fuel nozzle assembly 26 may include any suitable fuel nozzles and/or other suitable components, such as swozzles, as desired or required.

It should be understood that a fuel nozzle assembly 26 according to the present disclosure need not be a primary fuel nozzle assembly positioned upstream of the flow of fuel and working fluid 24 as shown. Rather, a fuel nozzle assembly 26 according to the present disclosure may be any suitable primary, secondary, or other fuel nozzle assembly that generally flows fuel and working fluid 24 into the casing 102. For example, in some embodiments, a fuel nozzle assembly 26 may be a late lean injection fuel nozzle assembly 26 positioned downstream of the location of a primary fuel nozzle relative to the flow of fuel and working fluid 24.

A system 100 according to the present disclosure further includes a viewing device 110. The viewing device 110 may be configured for capturing an image of at least a portion of the head end 108. For example, the head end 108 may be a camera, a camcorder, or any other suitable device for recording and/or storing images. The viewing device 110 may capture images in the visible spectrum, infrared spectrum, or ultraviolet spectrum, or any other images at any suitable wavelengths or ranges of wavelengths. In some embodiments, as shown in FIG. 2, the viewing device 110 may be mounted at least partially within the casing 102, such that a viewfinder or other viewing apparatus of the viewing device 110 has a direct view of at least a portion of the head end 108. A cooling device 112 may be connected to the viewing device 110 for cooling the viewing device 110 during operation of the combustion assembly 14. The cooling device 112 may utilize, for example, a closed loop air system, a closed loop water system, an open loop air system, or any other suitable cooling system using any suitable fluids. In alternative embodiments, as shown in FIG. 3, the viewing device 110 may be mounted outside of the casing 102. A suitable optics train 114 may be connected to the viewing device 110 and be mounted at least partially within the casing 102 such that a viewfinder or other viewing apparatus of the viewing device 110 has an indirect view through the optics train 114 of at least a portion of the head end 108. A cooling device 112 may be connected to the optics train 114 and/or viewing device 110.

A system 100 according to the present disclosure may further include a processor 120. The processor 120 may be communicatively coupled to the viewing device 110. For example, a data cable 122 or other suitable cable or physical coupling device may manually couple the viewing device 110 to the processor 120, or the processor 120 may be wirelessly coupled to the viewing device 110, such as through an infrared, cellular, sonic, optical, or radio frequency based coupling.

Further, the processor 120 may be configured to compare an image captured by the viewing device 110 to a standard image for the head end 108. For example, a standard image of at least a portion of the head end 108 may be taken when, for example, no combustion instabilities are occurring, and may thus establish a baseline view of the head end 108. This standard image may be stored in the processor 120. Images taken during operation of the combustor assembly 14 may then be compared to this standard image. The detection of differences between an image and the standard image by the processor 120 may allow the processor 120 to indicate the existence of, for example, a combustion instability. For example, a flashback may be indicated by a small region of high luminosity and white light in the visible spectrum. A blockage may be indicated by a local region of moderate luminosity and a red or orange color, or could result in a local area of reduced temperature on the head end 108 that would be detectable on an infrared image.

In some embodiments, the processor 120 may further be configured to convert the image, as well as the standard image, into a temperature map, a color spectrum map, or a brightness map. For example, the viewing device 110 may include various devices and apparatus for detecting temperature on the surface of the head end 108, the coloring of the surface of the head end 108, or the brightness of the surface of the head end 108. An image may then be converted, using differences in temperature, color, or brightness at various locations on the surface of the head end 108, to a temperature map, a color spectrum map, or a brightness map. The standard image may similarly be converted, and these converted images thus compared.

Figure 5:
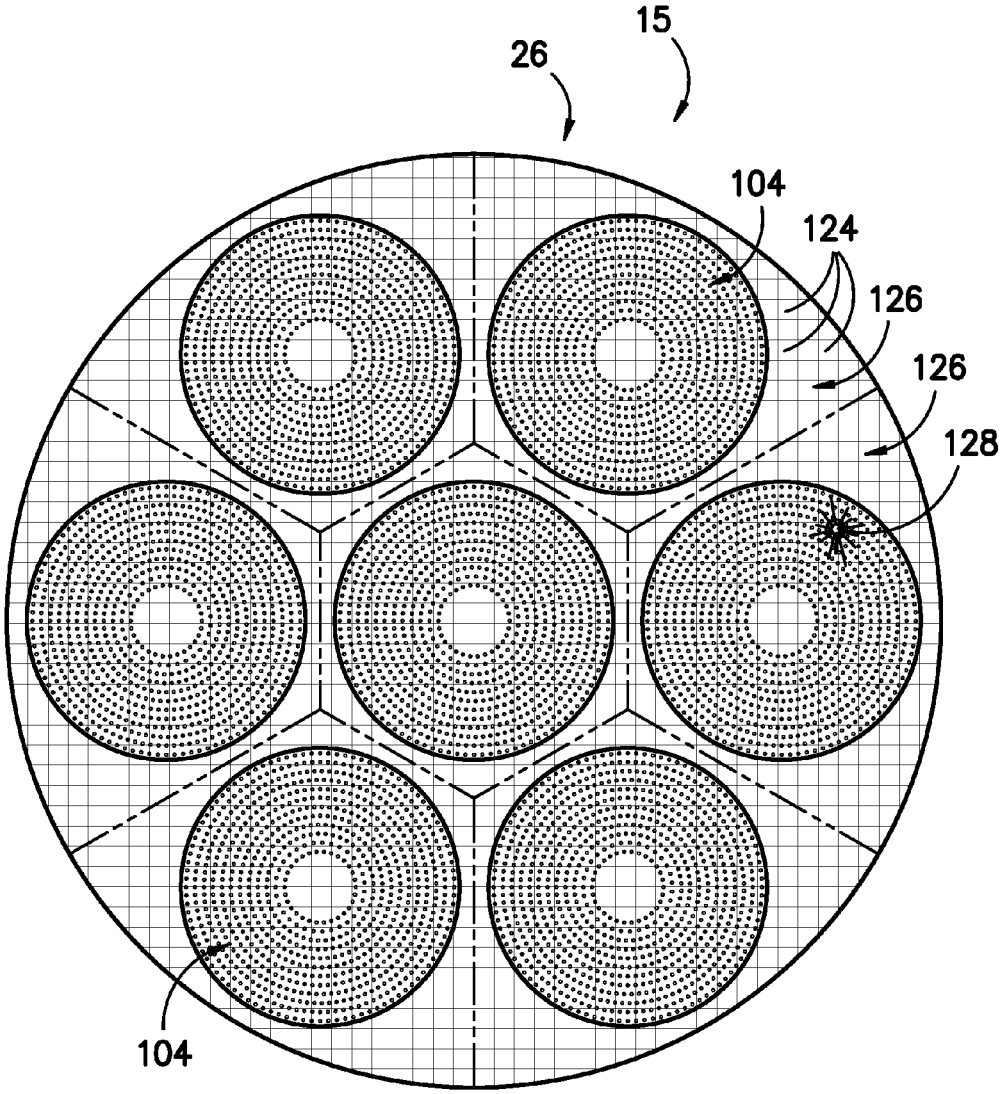
FIG. 5 is a front view image of a head end of a fuel nozzle assembly according to one embodiment of the present disclosure.

FIG. 5 illustrates an image of one embodiment of a head end 108. An image, including a standard image, according to the present disclosure, may include a plurality of pixels 124, as shown in FIG. 5. The image may be subdivided into such pixels 124 by the viewing device 110. The number of pixels 124 into which an image is divided may be based on the resolution of the viewing device 110—a higher resolution may result in more, smaller pixels 124, for example. Each pixel 124, or a zone 126 of pixels 124, of an image may be compared to the respective pixel 124 or zone 126 of pixels 124 of the standard image. For example, the pixels of zone 1 in an image may be compared to the respective pixels of zone 1 of the standard image.

After comparison of an image to a standard image, the processor 120 may determine whether the image and standard image, such as various portions thereof, are similar, such as based on color, brightness, temperature, or any other suitable characteristic, or whether the image and standard image, such as any various portions thereof, are different. If there are any differences for any portions of the image, such as any pixels 124, pluralities of pixels 124, zones 126, or pluralities of zones 126, that are outside of a pre-defined range relative to the standard image, these differences may indicate the existence of a combustion instability. For example, reference numeral 128 indicates one example of an indicator of a difference for a plurality of pixels 124 within a zone 126 that would indicate the existence of a combustion instability.

Any suitable imaging software, such as any software that can manipulate and compare images, may be utilized in the processor 120 to provide the above-described imaging capabilities. Further, the processor 120 may be incorporated into a suitable controller, such as a handheld remote, a personal digital assistant, cellular telephone, a separate pendant controller, or a computer. The processor 120 may be operated by a human operator, or may be partially or fully automated through the use of suitable programming logic incorporated into the processor 120.

A system 100 may further include a combustor control system 130. The combustor control system 130 may control various variables for the combustor assembly 14, such as fuel flow rate into a fuel nozzle assembly 26, working fluid 24 flow rate into a combustor 15, fuel split (percentage of total fuel) between various fuel nozzles 104 or fuel nozzle assemblies 26 in a combustor 15, fuel split between various combustors 15 of a combustor assembly 14, working fluid 24 split between various combustors 15 of a combustor assembly 14, flow direction, and/or inlet guide vane angle. In one embodiment, for example, the combustor control system 130 may control the amounts of various gases, such as, for example, methane, hydrogen, carbon monoxide, carbon dioxide, and/or nitrogen, in the fuel supplied to the fuel nozzles 104 and fuel nozzle assemblies 26. Thus, the control system 130 may include a suitable processor, hardware, and/or software for controlling such variables, and may be communicatively coupled with the various components of the combustor assembly 14, such as the combustors 15 and fuel nozzle assemblies 26, for controlling such variables.

The combustor control system 130 may further be communicatively coupled to the processor 120. For example, the processor 120 may be a component of the system 130, or the processor 120 may be coupled to the system 130 through a wired or wireless connection. The system 130 may be further configured to perform a responsive action if at least a portion of an image, such as a pixel 124, a plurality of pixels 124, a zone 126, or a plurality of zones 126, is outside of a pre-defined range relative to the standard image. The responsive action may a change in fuel flow rate into a fuel nozzle assembly 26, working fluid 24 flow rate into a combustor 15, fuel split between various combustors 15 of a combustor assembly 14, working fluid 24 split between various combustors 15 of a combustor assembly 14, flow direction, and/or inlet guide vane angle.

For example, in some embodiments, methane may be added to the fuel being provided to a fuel nozzle assembly 26. For example, a relatively small amount of methane, such less than or equal to approximately 2%, less than or equal to approximately 5%, or less than or equal to approximately 10% methane by volume may be added. The inventors of the present disclosure have discovered that the addition of methane is particularly effective at eliminating combustion instabilities. Additionally or alternatively, nitrogen or another inert gas may be added. It should be understood, however, that the present disclosure is not limited to the addition of any specific amounts of methane or nitrogen, and rather that the addition or subtraction of any suitable fluid is within the scope and spirit of the present disclosure.

Thus, a system 100 according to the present disclosure may advantageously detect and eliminate combustion instabilities in a combustor assembly 14. Operation of the system 100 may be in real-time, such that combustion instabilities are eliminated in real-time and the system 100 may continue with normal operation after such elimination. For example, in exemplary embodiments, images may be repeatedly captured at a specified time interval and then compared in real time after capturing to the standard image.

The present disclosure may further be directed to a method for controlling a combustor assembly 14. The method may include, for example, capturing an image of at least a portion of a head end 108 of a fuel nozzle assembly 26 for a combustor 15, as discussed above. The method may further include, for example, comparing the image to a standard image for the head end 108, as discussed above.

In some embodiments, the method may further include, for example, converting the image into a temperature map, a color spectrum map, or a brightness map, as discussed above.

In some embodiments, the method may further include performing a responsive action, as discussed above. The responsive action may be performed if at least a portion of the image is outside of a pre-defined range relative to the standard image.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for controlling a combustor assembly, the system comprising:

a combustor assembly comprising a combustor and a fuel nozzle assembly, the combustor comprising a casing, the fuel nozzle assembly positioned at least partially within the casing and comprising a fuel nozzle, the fuel nozzle assembly further defining a head end;

a viewing device facing the head end and configured for capturing an image of at least a portion of the head end; and a processor communicatively coupled to the viewing device, the processor configured to compare the image to a standard image for the head end.

2. The system of claim 1, wherein the viewing device is a camera.

3. The system of claim 1, wherein the viewing device captures visual images.

4. The system of claim 1, wherein the viewing device captures infrared images.

5. The system of claim 1, wherein the viewing device is mounted at least partially within the casing.

6. The system of claim 1, wherein the processor is further configured to convert the image into one of a temperature map, a color spectrum map, or a brightness map.

7. The system of claim 1, wherein the processor is further communicatively coupled to a combustor control system, and wherein the combustor control system performs a responsive action if at least a portion of the image is outside of a pre-defined range relative to the standard image.

8. The system of claim 7, wherein the responsive action is a change in one of fuel flow rate or working fluid flow rate.

9. The system of claim 1, wherein the image comprises a plurality of pixels, and wherein each of the plurality of pixels is compared to a respective pixel of the standard image.

10. The system of claim 1, wherein the fuel nozzle assembly further comprises a cap assembly.

11. The system of claim 1, wherein the fuel nozzle assembly comprises a plurality of fuel nozzles.

12. The system of claim 1, wherein the combustor assembly comprises a plurality of combustors.

13. A gas turbine, comprising:

a combustor assembly comprising a combustor and a fuel nozzle assembly, the combustor comprising a casing, the fuel nozzle assembly positioned at least partially within the casing and comprising a fuel nozzle, the fuel nozzle assembly further defining a head end;

a viewing device facing the head end and configured for capturing an image of at least a portion of the head end; and a processor communicatively coupled to the viewing device, the processor configured to compare the image to a standard image for the head end.

14. The gas turbine of claim 13, wherein the processor is further configured to convert the image into one of a temperature map, a color spectrum map, or a brightness map.

15. The gas turbine of claim 13, wherein the processor is further communicatively coupled to a combustor control system, and wherein the combustor control system performs a responsive action if at least a portion of the image is outside of a pre-defined range relative to the standard image.

16. A method for controlling a combustor assembly, the method comprising:

capturing an image of at least a portion of a head end of a fuel nozzle assembly for a combustor, the combustor comprising a casing, the fuel nozzle assembly positioned at least partially within the casing and comprising a fuel nozzle, the fuel nozzle assembly further defining the head end; and comparing the image to a standard image for the head end.

17. The method of claim 16, further comprising converting the image into one of a temperature map, a color spectrum map, or a brightness map.

18. The method of claim 16, further comprising performing a responsive action if at least a portion of the image is outside of a pre-defined range relative to the standard image.

19. The method of claim 18, wherein the responsive action is a change in one of fuel flow rate, working fluid flow rate, or fuel split.

20. The method of claim 16, wherein the image comprises a plurality of pixels, and wherein the comparing step comprises comparing each of the plurality of pixels to a respective pixel of the standard image.

* * * * *